US008194860B2

(12) United States Patent
Sugawara

(10) Patent No.: US 8,194,860 B2
(45) Date of Patent: Jun. 5, 2012

(54) AUDIO SIGNAL PROCESSING SYSTEM AND SURROUND SIGNAL GENERATION METHOD

(75) Inventor: Keitaro Sugawara, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 860 days.

(21) Appl. No.: 12/299,866

(22) PCT Filed: Apr. 5, 2007

(86) PCT No.: PCT/JP2007/057650

§ 371 (c)(1),
(2), (4) Date: Nov. 6, 2008

(87) PCT Pub. No.: WO2007/129517

PCT Pub. Date: Nov. 15, 2007

(65) Prior Publication Data

US 2009/0154714 A1 Jun. 18, 2009

(30) Foreign Application Priority Data

May 8, 2006 (JP) ..... 2006-129281

(51) Int. Cl.
*H04R 5/00* (2006.01)

(52) U.S. Cl. ..... 381/17; 381/18

(58) Field of Classification Search ..... 381/17, 381/18, 307

See application file for complete search history.

(56) References Cited

U.S. PATENT DOCUMENTS

| | | | | |
|---|---|---|---|---|
| 5,892,831 | A * | 4/1999 | Schott | 381/1 |
| 6,668,061 | B1 * | 12/2003 | Abel | 381/1 |
| 2008/0019533 | A1 * | 1/2008 | Noguchi et al. | 381/17 |

FOREIGN PATENT DOCUMENTS

| | | | |
|---|---|---|---|
| JP | 55-085199 | A | 6/1980 |
| JP | 10-070799 | A | 3/1998 |
| JP | 2000-102100 | A | 4/2000 |
| JP | 2003-152484 | A | 5/2003 |

* cited by examiner

*Primary Examiner* — Hung Vu
(74) *Attorney, Agent, or Firm* — Sughrue Mion, PLLC

(57) ABSTRACT

To provide an audio signal processing system, a surround signal generation method and so on that are capable of obtaining stable output signal level and feeling of soundscape without depending on an audio input signal. A DSP inputs audio input signals respectively corresponding to a plurality of channels, and generates surround signals that have reflection sound and reverberate sound and that respectively correspond to the plurality of channels. The DSP generates the surround signal corresponding to one channel based on an audio input signal corresponding to the one channel, a variable number changing within the predetermined range in response to a signal level of the surround signal at a preceding predetermined time corresponding to the one channel, and the audio input signal corresponding to the other channel.

8 Claims, 5 Drawing Sheets

AUDIO SIGNAL PROCESSING SYSTEM AND SURROUND SIGNAL GENERATION METHOD

CROSS REFERENCE TO RELATED APPLICATION

This application is a National Stage of International Application No. PCT/JP2007/057650 filed Apr. 5, 2007, claiming priority based on Japanese Patent Application No. 2006-129281, filed May 8, 2006, the contents of all of which are incorporated herein by reference in their entirety.

BACKGROUND OF THE INVENTION

1. Field of the Invention

The present invention belongs to the field of an audio signal processing, particularly a technology of generating a surround signal having reflected sound and reverberant sound.

2. Discussion of Related Art

In a conventional technique, there is known an art of SFC (Surround Field Control) for simulating an acoustic field image that is realistic and spatial by adding the reflected sound and reverberate sound (reverb) to the audio signals of music, movie and so on.

In a surround circuit disclosed in Patent Document 1 (Refer to FIG. 1), as an example of these arts, surround signals LS and RS are computed from audio input signals of left channel (Lch) and right channel (Rch). The surround signals Ls and Rs are respectively attenuated in an attenuation circuit, subsequently added by left and right audio input signals respectively in an adder circuit, and outputted. Thus, surrounding effect sound is generated to the listener. Patent Document 1: Japanese Unexamined Patent Publication No. 2000-102100

SUMMARY OF THE INVENTION

However, according to such the conventional SFC art, a signal level of the output signal widely fluctuates when the audio input signal fluctuates widely because the surround signal is generated based on the audio input signal (i.e. depending on signal level of the audio input signal). Then it becomes difficult to stabilize the signal level of the output signal, and therefore it becomes difficult to obtain a natural spreading feel of sound.

Therefore, an object of the present invention is to provide an audio signal processing device and a surround signal generation method that are capable of obtaining a stable output signal level and spreading feel without depending on audio input signals.

Means for Solving the Problem

In order to solve the above problem, according to the first aspect of the present invention there is provided an audio input signal inputting means for inputting audio input signals respectively corresponding to a plurality of channels; and a surround signal generation means for generating surround signals that have reflection sound and reverberate sound and that respectively correspond to the plurality of channels;

wherein the surround signal generation means generates the surround signal corresponding to one channel based on an audio input signal corresponding to the one channel, a variable number changing within a predetermined range in response to a signal level of the surround signal at a preceding predetermined time corresponding to the one channel, and the audio input signal corresponding to other channel.

According to another aspect of the present invention, there is provided a step of inputting audio input signals respectively corresponding to a plurality of channels; and a surround signal generation step of generating surround signals that have reflection sound and reverberate sound and that respectively correspond to the plurality of channels, wherein in the surround signal generation step, the surround signal corresponding to one channel is generated based on an audio input signal corresponding to the one channel, a variable number changing within a predetermined range in response to a signal level of the surround signal at the preceding predetermined time corresponding to the one channel, and the audio input signal corresponding to other channel.

According to another aspect of the present invention there is provided a computer to function as an audio input signal inputting means for inputting audio input signals respectively corresponding to a plurality of channels; and a surround signal generation means for generating surround signals that have reflection sound and reverberate sound and that respectively correspond to the plurality of channels, wherein the surround signal generation means generates the surround signal corresponding to one channel based on an audio input signal corresponding to the one channel, a variable number changing within a predetermined range in response to a signal level of the surround signal at the preceding predetermined time corresponding to the one channel, and the audio input signal corresponding to other channel.

According to another aspect of the present invention, a surround signal generation processing program is memorized so as to be readable by a computer.

EXPLANATION OF NUMERICAL REFERENCES

Figure 1:
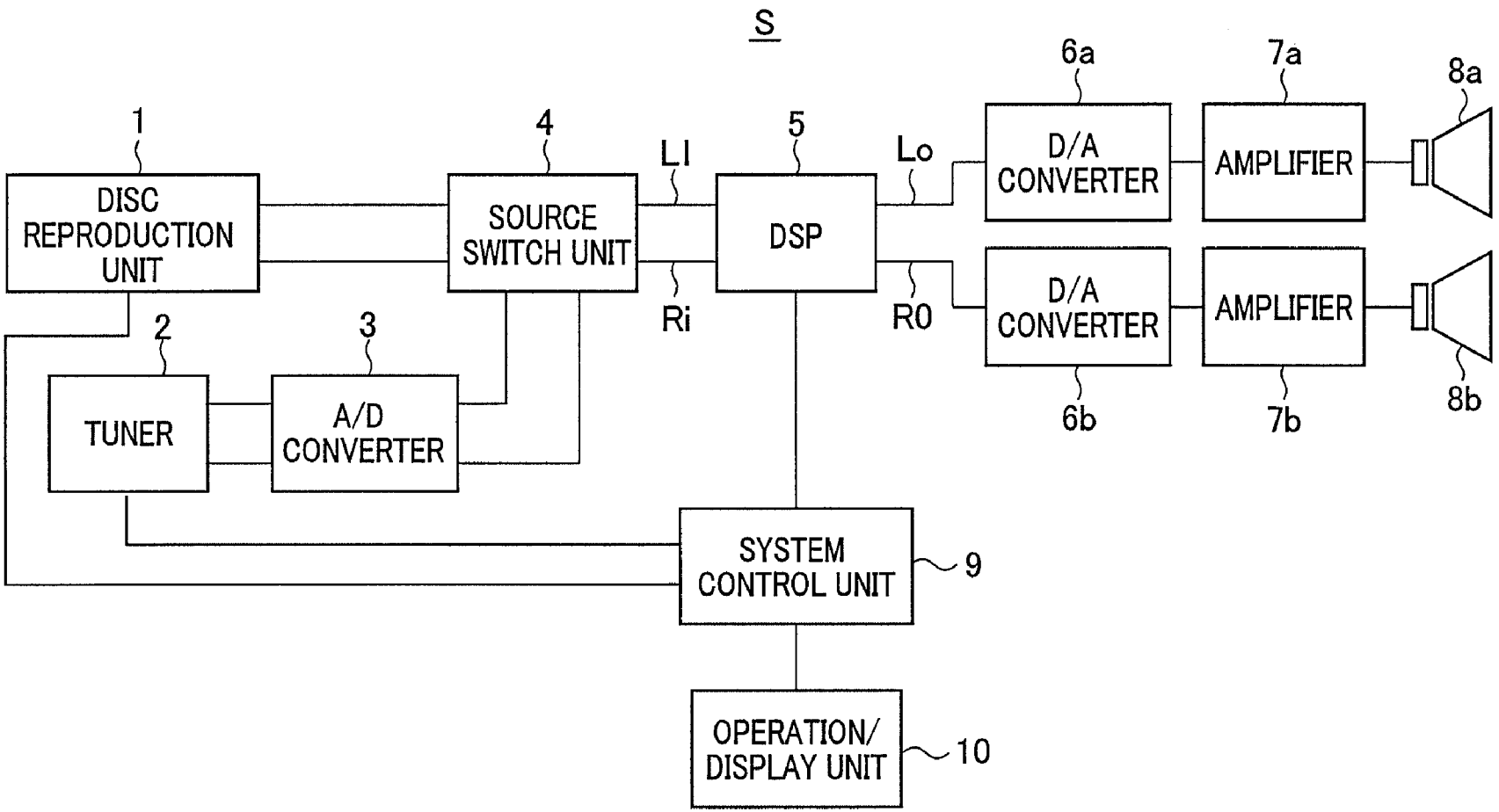
FIG. 1 A view showing a schematic configuration example of an audio reproduction system according to the present invention.

1 Disk reproduction unit
2 Tuner
3 A/D converter
4 Source switch unit
5 DSP
6*a*, 6*b* D/A converter
7*a*, 7*b* Amplifier
8*a*, 8*b* Speaker
9 System control unit
10 Operation/display unit
41 Surround signal generation unit
S Audio reproduction system

BEST MODE FOR CARRYING OUT THE INVENTION

Hereinafter, embodiments of the present invention will be described in reference of drawings. Here, in the embodiments explained below, the present invention is applied to an audio reproducing system installed inside a vehicle cabin or a room of building.

First, a configuration and a function of the audio reproduction system according to the present embodiment will be described with reference to FIG. 1.

FIG. 1 is a view showing a schematic configuration example of an audio reproduction system according to the present embodiment.

As shown in FIG. 1, the audio reproduction system S is configured by including a disc reproduction unit 1 that reads out recorded information from discs such as MD (Mini Disc), CD (Compact Disc), or DVD (Digital Versatile Disc) and reproduces and outputting audio input signals L and R; a tuner 2 that receives broadcast wave broadcasted from TV broadcast and radiobroadcast and reproducing and outputting thus received audio input signals Li and Ri; an A/D converter 3 that converts between analog and digital and outputs the audio input signals Li and Ri from the tuner 2; a source switch unit 4 that switches and outputs the audio input signals Li and Ri from the disc reproduction unit 1 and the audio input signals Li and Ri from the A/D converter 3; a DSP (Digital Signal Processor) 5 that provides the audio input signals Li and Ri from the source switch unit 4 with signal processing to be described later and outputs the audio output signals Lo and Ro; a D/A converter (DAC) 6*a*, 6*b* that converts between digital and analog and outputs the audio output signals Lo and Ro from the DSP 5; an amplifier 7*a*, 7*b* that amplifies and outputs the audio output signals Lo and Ro from the D/A converter 6*a*, 6*b*; a speaker 8*a*, 8*b* that outputs the audio output signals Lo and Ro from the amplifier 7*a*, 7*b* as sound wave; a system control unit 9; and an operation/display unit 10 that has an operation button for receiving various operation instructions from a user and a display panel for displaying various information.

Here, detail description on function of the disc reproduction unit 1 and the tuner 2 is omitted because these are known.

Here, the audio input signal Li corresponds to a left channel (hereinafter referred to as "Lch") and the audio input signal Ri corresponds to a right channel (hereinafter referred to as "Rch"). These audio input signals Li and Ri are stereo signals, and sound sources of the audio input signals are different from each other.

The system control unit 9 has a CPU (Central Processing Unit), a ROM (Read Only Memory), and a working RAM (Random Access Memory). The CPU runs a predetermined program and controls operation of the entire audio reproduction system S in response to instruction signals from the operation unit 10 (e.g. audio reproduction instruction, tuning instruction, source switch instruction, and so on).

The DSP 5 executes a predetermined program including a surround signal generation process program according to the present invention to function as an audio input signal inputting means, a surround signal generation means, an audio output signal generation means or the like according to the present invention, and inputs audio input signals Li and Ri respectively corresponding to Lch and Rch. The DSP 5 generates surround signals Ls and Rs that have a reflection sound and a reverberate sound and that respectively correspond to Lch and Rch, adds the audio input signals Li and Ri to the surround signals Ls and Rs with respect to every channel, generates the audio output signals Lo and Ro (e.g. addition of the audio input signal Li to the surround signal Ls corresponding to a channel of the audio input signal Li and generation of the audio output signal Lo) and outputs respectively.

Here, the surround signal generation process program of the present invention is provided with an audio reproduction system S and may be memorized in, for example, ROM or the like in advance. For example, it may be configured such that the surround signal generation process program is memorized and stored in a predetermined server connected to an internet or the like, downloaded from the server to the audio reproduction system S, and memorized in a nonvolatile memory or a hard disc included in, for example, the audio reproduction system S or the program thus recorded in a recording medium such as CD-ROM may be read into the audio reproduction system S through a drive or the like and memorized in a nonvolatile memory or a hard disc.

Further, a DSP 5 for Lch and a DSP 5 for Rch may be separately provided.

Next, a basic concept of a method of generating a surround signal and an audio output signal in DSP 5 is described.

The surround signals Ls and Rs are generated based on the following Formulas (1) and (2).

$$Ls(t)=Li(t)+Ri(t)\cos(\theta 1-\theta 2|Ls(t-1)|) \quad (1)$$

$$Rs(t)=Ri(t)+Li(t)\cos(\theta 1-\theta 2|Rs(t-1)|) \quad (2),$$

where t designates a time, |Ls(t−1)| does an absolute value of signal level (amplitude being in proportional to sound loudness) of the surround signal Ls(t−1) at a preceding predetermined time (e.g. a time preceding 1 sampling time) of the surround signal Ls (t), and |Rs(t−1)| does an absolute value of signal level (amplitude) of the surround signal Rs(t−1) at a preceding predetermined time (e.g. a time preceding 1 sampling time) of the surround signal Rs (t). Further, an amplitude of the surround signals Ls and Rs is adjusted so as to fluctuate within a range of from −2 (minimum) to 2 (maximum). Further, θ1 and θ2 can be arbitrarily set up in response to a desired sound field (e.g. upon operation by a user of using an operation button).

Accordingly, it is found that a surround signal Ls is generated based on an audio input signal Li, a variable number (cos(θ1−θ2|Ls|)) changing within the predetermined range in response to the signal level of the surround signal Ls (the surround signal corresponding to Lch) at a preceding predetermined time (e.g. 1 sampling time before), and an audio input signal Ri.

On the other hand, it is known that a surround signal Rs is generated based on an audio input signal Ri, a variable number (cos(θ1−θ2|Rs|)) changing within a predetermined range in response to the signal level of the surround signal Rs (the surround signal corresponding to Rch) at a preceding predetermined time (e.g. a time preceding 1 sampling time), and an audio input signal Li.

Here, in this example, the variable number changing within the predetermined range in response to the signal level of the surround signal is a variable number that is obtained by a cosine function (cos θ), and the predetermined range is any range of between −1 and +1.

Thus, the surround signals Ls and Rs are generated based on the surround signals Ls and Rs at the preceding predetermined time (e.g. a time preceding 1 sampling time) so as to restrict and stabilize the range using a cosine function (cos θ) (not depending on only the audio input signal L).

Meanwhile, Formulas (1) and (2) in the above are transformed to the following Formulas (3) and (4), where "−cos(θ1−θ2|Ls(t−1)|)" is set up as $w_L$, and "−cos(θ1−θ2|Rs(t−1)|)" is set up as $w_R$ (t being omitted for simplification).

$$Ls=Li-Riw_L \quad (3)$$

$$Rs=Ri-Liw_R \quad (4)$$

For example, according to the above Formula (3), an audio input signal Ri component of the other channel is subtracted from an audio input signal Li component by a rate of $w_L$ to obtain the surround signal Ls. The control of deducting a certain amount of component of the audio input signal Ri is realized by cos θ (concept similar to that in the surround signal Rs).

The audio output signals Lo and Ro are generated based on the following Formulas (5) and (6).

$$Lo(t)=Li(t)+Ls(t) \quad (5)$$

$$Ro(t)=Ri(t)+Rs(t) \quad (6)$$

For example, according to the above Formula (5), it is found that the audio output signal Lo is generated by adding the audio input signal Li to the surround signal Ls.

Next, a more detailed process in the DSP 5 will be described with reference to FIGS. 2 and 3.

Figure 2:
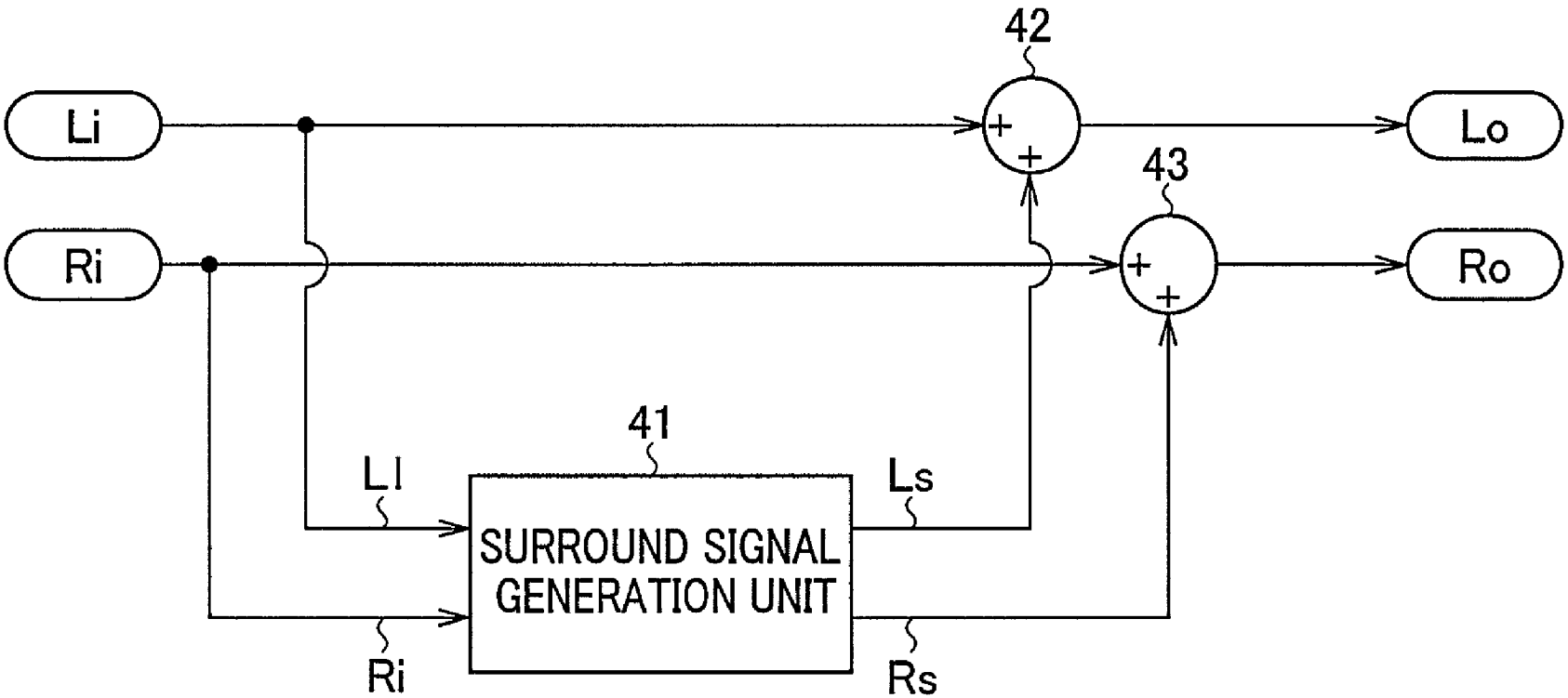
FIG. 2 A view showing a generation signal flow of audio output signals Lo and Ro in DSP 5.

FIG. 2 is a view showing a generation signal flow of audio output signals Lo and Ro in DSP 5, and this expresses a specific signal flow based on the above Formulas (5) and (6). FIG. 3 is a view showing a detail of the generation signal flow of surround signal Ls in a surround signal generation unit in FIG. 2, and this expresses a specific signal flow based on the above Formula (1). Here, the generation signal flow of the surround signal Rs is a flow similar thereto while mutually replacing L and R in FIG. 3. Therefore, illustration is omitted and explanation overlapped with the generation of the surround signal Rs is also omitted. Further, units designated as 41 to in FIG. 2 and as 51 to 59 in FIG. 3 designate a operation processing portion achieved by DSP 5.

In the generation signal flow of the audio output signals Lo and Ro shown in FIG. 2, the audio input signal Li inputted into the DSP 5 is inputted into a surround signal generation unit 41 and an addition unit 42, and audio input signal Ri is inputted into the surround signal generation unit 41 and the addition unit 43.

Figure 3:
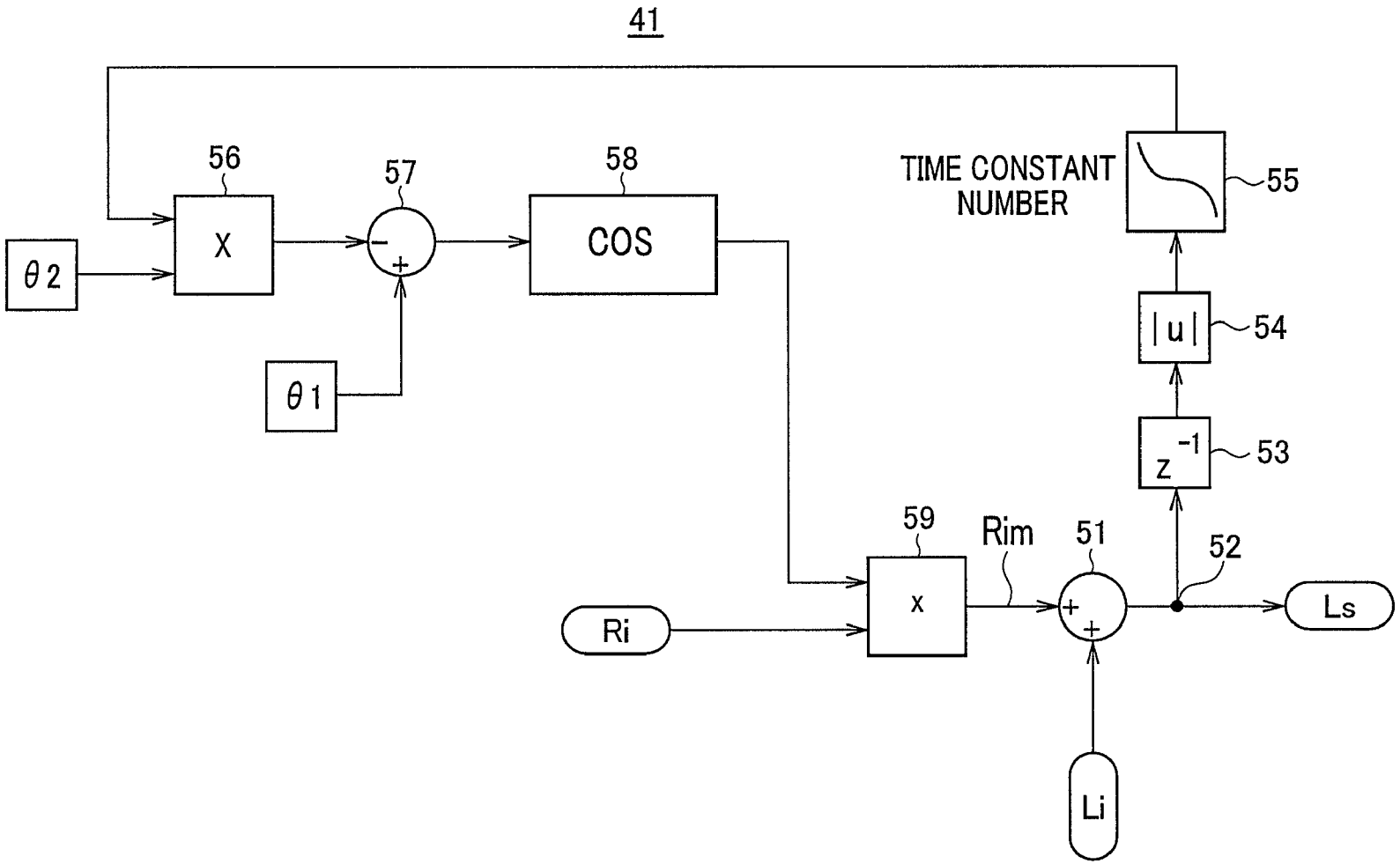
FIG. 3 A view showing a detail of the generation signal flow of a surround signal Ls in a surround signal generation unit in FIG. 2

Next, in the generation signal flow of the surround signal Ls shown in FIG. 3, the audio input signal Li and the intermediate signal Rim are added by an addition unit 51 to thereby generate the surround signal Ls, and the surround signal Ls is divided by a branch unit 52, outputted from the surround signal generation unit 41 at one end and fed back at the other end.

The other surround signal Ls first extracts the surround signal Ls at the time of previous one sampling time by a signal extraction unit 53 in the course of the feedback.

Next, an absolute value of the surround signal Ls at the time of previous one sampling time is calculated by an absolute value calculation unit 54, and then the signal passes through a primary lowpass filter 55 as an example of a time constant number circuit to slow rise of the signal in response to the predetermined time constant number. Here, the reason why the lowpass filter 55 is passed through is to restrict a sudden change of the surround signal Ls and smooth the signal.

Next, an absolute value of the surround signal Ls passing through the lowpass filter 55 is multiplied by the predetermined θ2 by a multiplication unit 56 and "θ2|Ls|" is calculated as a result.

Next, the preset θ1 and −θ2|Ls| are added by the addition unit 57 and subsequently cos(θ1−θ2|Ls|) is calculated by a cos (cosine) calculation unit 58.

Next, thus calculated cos (θ1−θ2|Ls|) and the audio input signal Ri are multiplied by the multiplication unit 59 and the intermediate signal Rim (multiplied signal) is generated.

The generated intermediate signal Rim thus generated is added to the audio input signal Li by the addition unit 51 and the surround signal Ls is generated and outputted.

The surround signal Ls thus generated and outputted from the surround signal generation unit 41 is inputted into the addition unit 42 as shown in FIG. 2 and added to the audio input signal Li to generate the audio output signal Lo, and outputted from the DSP 5 (actually, the audio output signal Lo being appropriately subject to well-known signal processes such as loudness calculation, EQ appropriately in the DSP 5 and being outputted). In a manner similar thereto, the surround signal Rs outputted from the surround signal generation unit 41 is inputted into the addition unit 43, added to the audio input signal Ri to generate the audio output signal Ro, and outputted from the DSP 5 as shown in FIG. 2.

Here, in a case where there is a large delay in generating surround signals Ls and Rs in the surround signal generation unit 41 thereby causing delay, a delay unit may be provided in a front stage of the addition units 42 and 43 so that the audio input signals Li and Ri are delayed for a predetermined time (synchronous timing or a time of arbitral delay difference) by the delay unit and inputted to the addition units 42 and 43 in order to synchronize the audio input signal and the surround signal or to provide an arbitrary delay difference to the audio input signals Li and Ri and the surround signals Ls and Rs.

The above processes are carried out with respect to every sampling in a chronologic order.

Next, an embodiment in a case where θ1 and θ2 are set up with a specific value (desirable value) is explained. Here, Lch is typically explained as a representative.

Figure 4A:
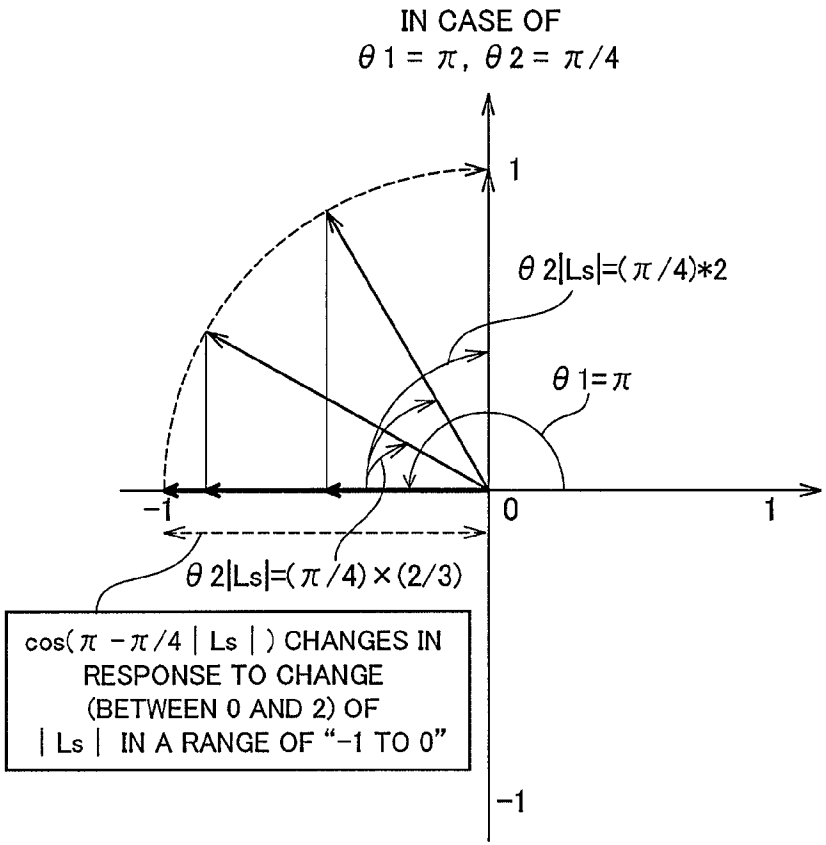
FIG. 4A A view showing an example of motion of "cos ($\theta 1-\theta 2|Ls|$), where $\theta 1=\pi$ and $\theta 2=\pi/4$.

FIG. 4A is a view showing an example of motion of "cos (θ1−θ2|Ls|)" where θ1=π, θ2=π/4. In a case where θ1=π, θ2=π/4, cos(π−π/4|Ls|) changes in response to change (0 to 2) of |Ls| in a range of −1 to 0 as shown in FIG. 4A.

Accordingly, for example, when a signal level of the surround signal Ls is low, $w_L$ (=−cos (π−π/4|Ls|) becomes large (near to 1), so that a difference signal component of "Li−Ri" is dominant in the surround signal Ls according to the above formula (3). On the other hand, for example, when a signal level of the surround signal Ls is large, $w_L$ becomes low (near to 0), so that an audio input signal Li component is dominant in the surround signal Ls according to the above Formula (3).

Especially, when the audio input signal Li is in a phase opposite to the audio input signal Ri, and $w_L$ is high (little sound), it becomes close to the surround signal Ls=Li−Ri=2Li and capable of making the sound large. When $w_L$ is low (large sound), it becomes closer to a relation of the surround signal Ls=Li, thereby avoiding sound from being large. Accordingly, it is possible to control to stabilize the signal level of the surround signal Ls.

Figure 4B:
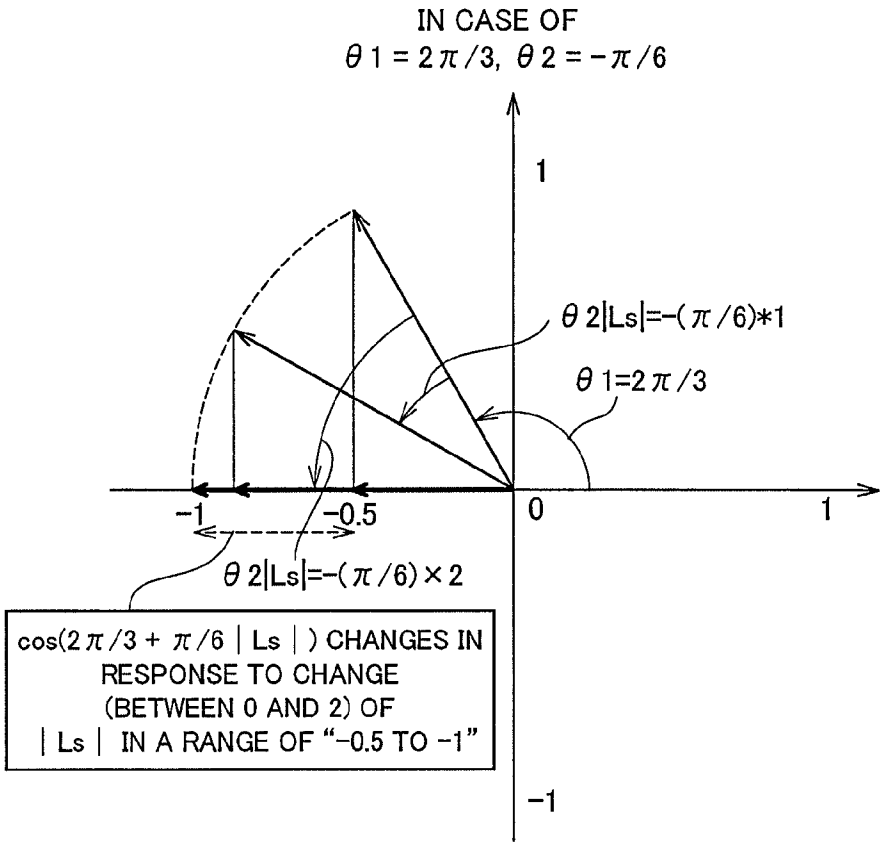
FIG. 4B A view showing an example of motion of "cos ($\theta 1-\theta 2|Ls|$), where $\theta 1=2\pi/3$ and $\theta 2=-\pi/6$.

FIG. 4B is a view showing an example of motion of "cos (θ1−θ2|Ls|)" where θ1=2π/3, θ2=−π/6. As shown in FIG. 4B, in a case where θ1=2π/3, θ2=−π/6, cos (2π/3+π/6|Ls|) changes in response to change (0 to 2) of |Ls| in a range of −0.5 to −1 (i.e. changes in narrower range than in FIG. 4A).

Accordingly, for example, based on the fact that $w_L$ becomes large (closer to 1 from 0.5) as the signal level of the surround signal Ls becomes high, the difference signal component of "Li−Ri" becomes dominant to increase sound spacious feeling, regardless of the signal level, and it is further possible to increase the sound spacious feeling as the sound becomes large.

Here, a variety of combinations can be considered in addition to a combination of the above values θ1 and θ2. As an example, it is possible to consider the combination of values θ1 and θ2 after determining what range and what direction "cos(θ1−θ2|Ls|)" are controlled (i.e. increment or decrement of |Ls| in proportional to a change from 0 to 1). For example, besides the combination of values of the above θ1 and θ2, a combination of values θ1=4π/5 and θ2=π/4 can be considered as desirable.

It is desired to make combination of values θ1 and θ2 selectable when the listener operates the operation/display unit 10.

For example, the system control unit 9 causes selection buttons, that displays character of listening mode 1, listening mode 2, and listening mode 3, to respectively display so as to be selectable (any one of the modes) on a display panel in the operation/display unit 10, in response to a mode selection instruction from the listener through the operation/display unit 10. In a case where the listening mode 1 is selected, it is configured such that θ1=π and θ2=π/4 previously memorized in correspondence with the mode 1 are set up. In a case where the listening mode 2 is selected, it is configured such that θ1=2π/3 and θ2=−π/6 previously memorized in correspondence with the mode 2 are set up. In a case where the listening mode 3 is selected, it is configured such that θ1=4π/5 and θ2=π/4 previously memorized in correspondence with the mode 3 are set up. The values θ1 and θ2 thus set up are transferred from the system control unit 9 to the DSP 5 and set up in the DSP 5. Accordingly, listeners can select their desired mode depending on how they want to enjoy the audio in a listening space (in other words, desired sound field).

As explained above, according to the above-mentioned embodiment, the audio input signals Li and Ri respectively corresponding to Lch and Rch are inputted, the surround signal Ls is generated based on the audio input signal Li, the variable number changing within the predetermined range in response to the signal level of the surround signal Ls at a preceding predetermined time, and the audio input signal Ri (e.g. the variable number changing within the predetermined range in response to the signal level of the surround signal Ls at the preceding predetermined time before being multiplied by the audio input signal Ri, and thus multiplied signal and the audio input signal Li being added) Further the surround signal Rs is generated based on the audio input signal Ri, the variable number changing within the predetermined range in response to the signal level of the surround signal Rs at the preceding predetermined time, and the audio input signal Li, and such the surround signals Ls and Rs and the audio input signals Li and Ri are added and outputted as the audio output signals Lo and Ro, so that it is possible to obtain a stable output signal level (output signal levels of the surround signal and the audio output signal) that does not depend on the audio input signals Li and Ri and feeling of soundscape (i.e. sound effect). For example, when listeners enjoy the audio in the vehicle room, it is possible to improve a sound field impression of closure feeling peculiar the vehicle interior and create a natural soundscape and extensity.

Further, the variable number changing within the predetermined range in response to the signal level of the surround signal is obtained by a cosine function (cos θ), so that it is possible to stabilize the surround signal by further restricting the range. Because this is fed back to generate the surround signal, it is possible to obtain the further stable signal level and the feeling of soundscape of the surround output signal.

Further, a θ value in the cosine function (cos θ) is arbitrarily settable and the above-mentioned predetermined range is configured to be determined by the θ value. Therefore, it is possible to realize optimal audio output appropriate to the sound field desired by listeners.

Here, in the above-mentioned embodiment, the generation signal flow of the audio output signals Lo and Ro shown in FIG. 2 is a basic configuration, and the other variety of computing processing units may be provided. For example, FIG. 5 is a modified example of the generation signal flow of the audio output signals Lo and Ro shown in FIG. 2 (construction elements similar to FIG. 2 have the same reference numerals).

Figure 5:
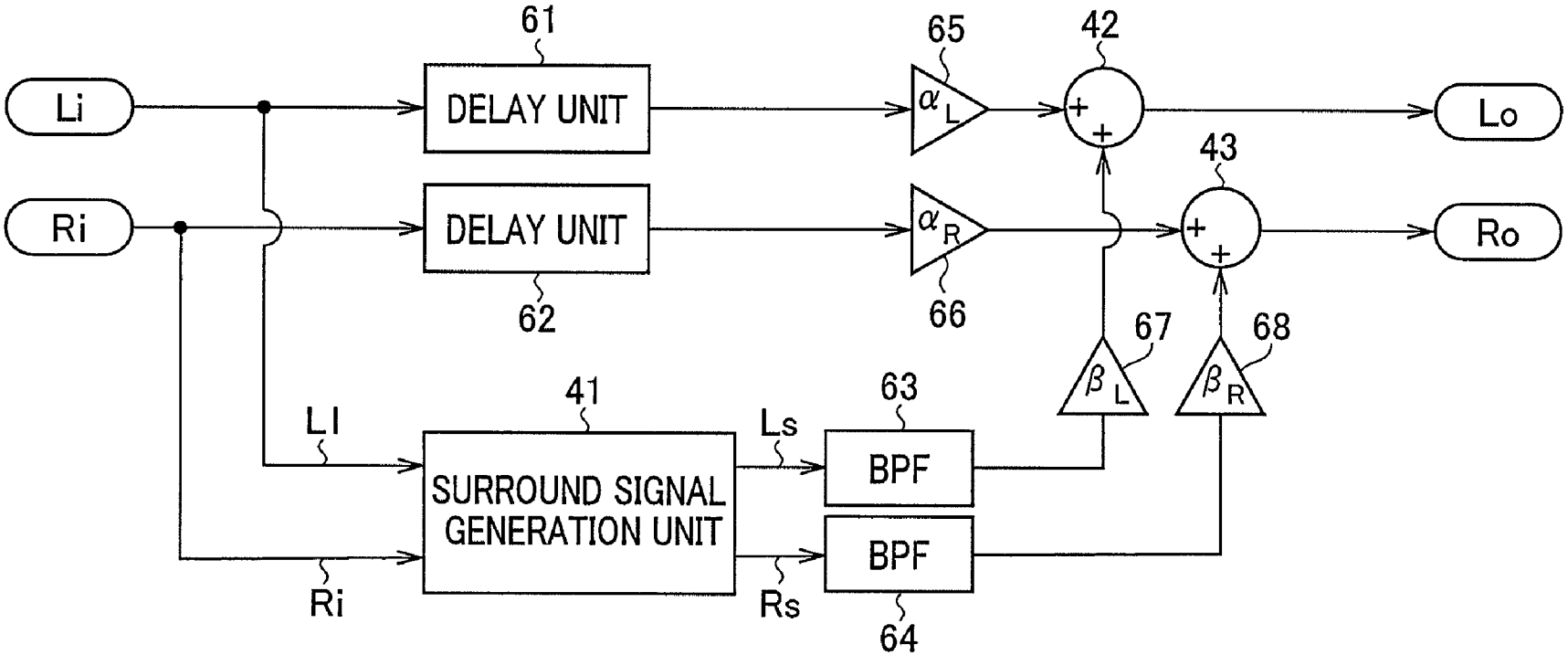
FIG. 5 A view showing a modified example of a generation signal flow of audio output signals Lo and Ro.

In the generation signal flow of the audio output signals Lo and Ro shown in FIG. 5, the audio input signals Li and Ri inputted in the DSP 5 are respectively delayed by the delay units 61 and 62 (for synchronizing with the surround signal). On the other hand, the surround signals Ls and Rs outputted from the surround signal generation unit 41 pass through the BPFs (band pass filters) 63 and 64 to extract only the surround signals Ls and Rs of the predetermined band (e.g. a certain range of band having vocal band or the like). Accordingly, it is possible to increase the feeling of soundscape only of the predetermined band.

Further in the generation signal flow shown in FIG. 5, the reference numerals 65 to 68 are addition rate determination units for determining an addition rate between audio input signal and surround signal. The addition rate of the audio output signal Lo from the delay unit 61 to the surround signal Ls from the BPF 63 is determined by a ratio of $\alpha_L$ to $\beta_L$ shown in FIG. 5 whereas the addition rate of the audio output signal Ro from the delay unit 62 to the surround signal Rs from the BPF 64 is determined by a ratio of $\alpha_R$ to $\alpha_R$ shown in FIG. 5. For example, when $\alpha_L:\beta_L=1:0.5$, the surround signal Ls with the signal level attenuated by half of the original level is added to the audio output signal Lo (by the addition unit 42) and the audio output signal Lo is generated. Accordingly, it is possible to adjust the feeling of soundscape.

Further, in the generation signal flow shown in FIG. 5, it may be configured in such manner that a delay unit is provided in a latter part of the BPFs 63 and 64, and the delay unit delays respectively the surround signal Ls from the BPF 63 and the surround signal Ls from the BPF 64 (i.e. delaying them behind the audio input signals Li and Ri on purpose). Accordingly, it is possible to obtain feeling of soundscape different from the above-mentioned configuration.

Further, although the variable number changing within the predetermined range in response to the signal level of the surround signal is obtained by the cosine function (cos θ), in the above-mentioned embodiment, the configuration is not limited thereto. For example, it may be configured to be obtained by a sine function (sin θ). In a case of using the sine function (sin θ), the similar effect can be obtained by the similar result from shifting (e.g. setting forward) the value of θ1 and θ2 by π/2, with respect to the cosine function (cos θ).

Further, although 2 channels of Lch and Rch is exemplified for explanation in the above embodiment, the basic configuration is similar such that in case of 3 channels or more, the variable number changing within the predetermined range in response to the signal level of the surround signal of one channel is multiplied by the audio input signal of the other channel, thus multiplied signal and the audio input signal of one channel are added to generate surround signal.

Further, although in the above-mentioned embodiment, the audio input signals Li and Ri and the surround signals Ls and Rs are added to generate and output the audio output signals Lo and Ro, the configuration is not limited thereto. It may be configured in such manner that the generated surround signals Ls and Rs are outputted as-is (e.g. outputted from a speaker exclusively used for the surround signal (a speaker corresponding to any two channels in case of 5.1 channel).

The invention claimed is:

1. An audio signal processing system comprising:

an audio input signal inputting device that inputs audio input signals respectively corresponding to a plurality of channels; and a surround signal generation device that generates surround signals that have reflection sound and reverberate sound and that respectively correspond to the plurality of channels, wherein the surround signal generation device generates the surround signal corresponding to one channel based on an audio input signal corresponding to the one channel, a variable number changing within a predetermined range in response to a signal level of the surround signal at a preceding predetermined time corresponding to the one channel, and the audio input signal corresponding to other channel.

2. The audio signal processing system according to claim 1, wherein the surround signal generation device multiplies the variable number changing within the predetermined range in response to the signal level of the surround signal at a preceding predetermined time corresponding to the one channel by the audio input signal corresponding to the other channel, the signal thus multiplied is added to the audio input signal corresponding to the one channel to generate the surround signal corresponding to the one channel.

3. The audio signal processing system according to claim 1, further comprising:

an audio output signal generation device that adds the audio input signal to the surround signal corresponding to the channel of the audio input signal with respect to every channel to generate the audio output signal.

4. The audio signal processing system according to claim 1, wherein the variable number is obtained by a cosine function or a sine function.

5. The audio signal processing system according to claim 1, wherein a value of $\theta$ in the cosine function and the sine function is arbitrarily settable, and the predetermined range is determined by the value of $\theta$.

6. The audio signal processing system according to claim 1, wherein the surround signal generation device multiplies the variable number changing within the predetermined range in response to the signal level of the surround signal at the preceding predetermined time corresponding to the one channel passed through a time constant number circuit by the audio input signal corresponding to the other channel.

7. A surround signal generation method comprising:

a step of inputting audio input signals respectively corresponding to a plurality of channels; and a surround signal generation step of generating surround signals that have reflection sound and reverberate sound and that are respectively correspond to the plurality of channels, wherein in the surround signal generation step, the surround signal corresponding to one channel is generated based on an audio input signal corresponding to the one channel, a variable number changing within a predetermined range in response to a signal level of the surround signal at a preceding predetermined time corresponding to the one channel and the audio input signal corresponding to other channel.

8. A surround signal generation processing program embodied in a computer-readable medium and representing a sequence of instructions, which when executed by a computer, the instructions cause the computer to function as:

an audio input signal inputting device that inputs audio input signals respectively corresponding to a plurality of channels; and a surround signal generation device that generates surround signals that have reflection sound and reverberate sound and that respectively correspond to the plurality of channels, wherein the surround signal generation device generates the surround signal corresponding to one channel based on an audio input signal corresponding to the one channel, a variable number changing within a predetermined range in response to a signal level of the surround signal at a preceding predetermined time corresponding to the one channel, and the audio input signal corresponding to other channel.

* * * * *